US007743557B2

(12) United States Patent
Liao

(10) Patent No.: US 7,743,557 B2
(45) Date of Patent: Jun. 29, 2010

(54) SLIDING TRACK COUPLING STRUCTURE FOR SLIDING DOORS

(75) Inventor: Shou-Hsing Liao, Taichung (TW)

(73) Assignee: Good Credit Corporation, Taichung (TW)

( * ) Notice: Subject to any disclaimer, the term of this patent is extended or adjusted under 35 U.S.C. 154(b) by 675 days.

(21) Appl. No.: 11/602,365

(22) Filed: Nov. 21, 2006

(65) Prior Publication Data

US 2008/0115329 A1 May 22, 2008

(51) Int. Cl.
*E05D 15/06* (2006.01)

(52) U.S. Cl. ..... 49/409; 49/425; 16/95 R

(58) Field of Classification Search ..... 49/404, 49/409–412, 425; 16/87 R, 87.4 R, 94 R, 16/95 R, 96 R, 98, 102; 160/196.1
See application file for complete search history.

(56) References Cited

U.S. PATENT DOCUMENTS 3,155,149 A * 11/1964 Ford ..... 160/346
3,302,354 A * 2/1967 Mermell ..... 52/476
3,309,816 A * 3/1967 Malone, Jr. ..... 49/127
RE26,269 E * 9/1967 Ford ..... 160/346
3,693,293 A * 9/1972 Egan et al. ..... 49/56
4,286,716 A * 9/1981 Budich et al. ..... 206/577
4,406,436 A * 9/1983 Benthin ..... 248/262
4,458,449 A * 7/1984 Breuer ..... 49/411
4,840,216 A * 6/1989 John ..... 160/178.1 V
6,647,590 B2 * 11/2003 Haab et al. ..... 16/90
2005/0097842 A1 * 5/2005 Arcamonte et al. ..... 52/204.5
2005/0235571 A1 * 10/2005 Ewing et al. ..... 49/410
2006/0277850 A1 * 12/2006 Gravel et al. ..... 52/204.51

FOREIGN PATENT DOCUMENTS

EP 565039 A1 * 10/1993
GB 2152991 A * 8/1985
WO WO 9922104 A1 * 5/1999

* cited by examiner

*Primary Examiner*—Katherine W Mitchell
*Assistant Examiner*—Michael J Keller
(74) *Attorney, Agent, or Firm*—Muncy, Geissler, Olds & Lowe, PLLC

(57) ABSTRACT

A sliding track for sliding doors includes a sliding door track and a glass fixed panel track which have an inverted U-shape cross section with an opening facing downward. The sliding door track has a left and a right inner wall that have a pair of guiding tracks formed thereon to allow a plurality pairs of rollers which are hinged on a hanging track which is fastened to a sliding door on a lower side to roll thereon in a straddle manner. The sliding door track further has a pair of first wedge troughs on the upper left and upper right corners, and a pair of second wedge troughs on a lower side. The first and second wedge troughs are coupled with the glass fixed panel track. The sliding door track and the glass fixed panel track may also be coupled with an ornamental plate on the top. The glass fixed panel track may further be coupled with a sealing plate on the bottom.

2 Claims, 5 Drawing Sheets

SLIDING TRACK COUPLING STRUCTURE FOR SLIDING DOORS

FIELD OF THE INVENTION

The present invention relates to a sliding track above a sliding door and particularly to a sliding track that can be individually installed and flexibly removed according to different installation sites.

BACKGROUND OF THE INVENTION

The general sliding doors (may be glass doors driven electrically) can provide partition function and do not take much space during opening and closing, thus are widely used. For instance they are commonly used on shops or bathrooms to separate an inner room and an outer room. Some sliding doors are fixedly fastened to the ceiling. Some other sliding doors have the top portion spaced from the ceiling at a selected distance to provide desired air ventilation and light projection effect. Some sliding doors are mounted onto one side of a glass fixed panel to facilitate opening and closing of the sliding doors. There are also sliding doors installed on display windows of shops. The display windows have a glass fixed panel on one side and a sliding door on another side that can be opened or closed.

Depending on installation sites of the sliding door, different types of tracks have to be provided. For instance, if a track is provided for moving a sliding door, the track also has to provide a clipping trough on another side to fasten and clip a glass fixed panel. To install the sliding door on the left side and right side the profile of the track is also different. Because of installation sites vary widely the conventional fixed track cannot be flexibly adapted, thus is not convenient in use.

SUMMARY OF THE INVENTION

In view of the aforesaid disadvantages occurred to the conventional sliding tracks of the sliding doors, the primary object of the present invention is to provide a sliding track coupling structure for sliding doors that includes a sliding door track and a glass fixed panel track that are formed with an inverted U-shape cross section with the opening facing downwards. The glass fixed panel track clips a glass fixed panel on a lower side. The sliding door track has a pair of guiding tracks on a left inner wall and a right inner wall to allow a plurality pairs of rollers to roll thereon in a straddle manner. The rollers are hinged on a hanging track which has a lower side fastening to a sliding door. The sliding door track has a pair of first wedge troughs on an upper left corner and an upper right corner, and a pair of second wedge troughs on a lower side. The first and second wedge troughs are coupled with a latch portion and a hook of the glass fixed panel track. The top portion of the sliding door track and the glass fixed panel track may also be coupled with an ornamental plate to form a closed top portion of the sliding door track and the glass fixed panel track. The glass fixed panel track may further couple with a sealing plate on the bottom thereof to seal the exposed portion of the clipping trough. Thus the elements of the invention can be individually installed and flexibly removed according to different installation sites.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
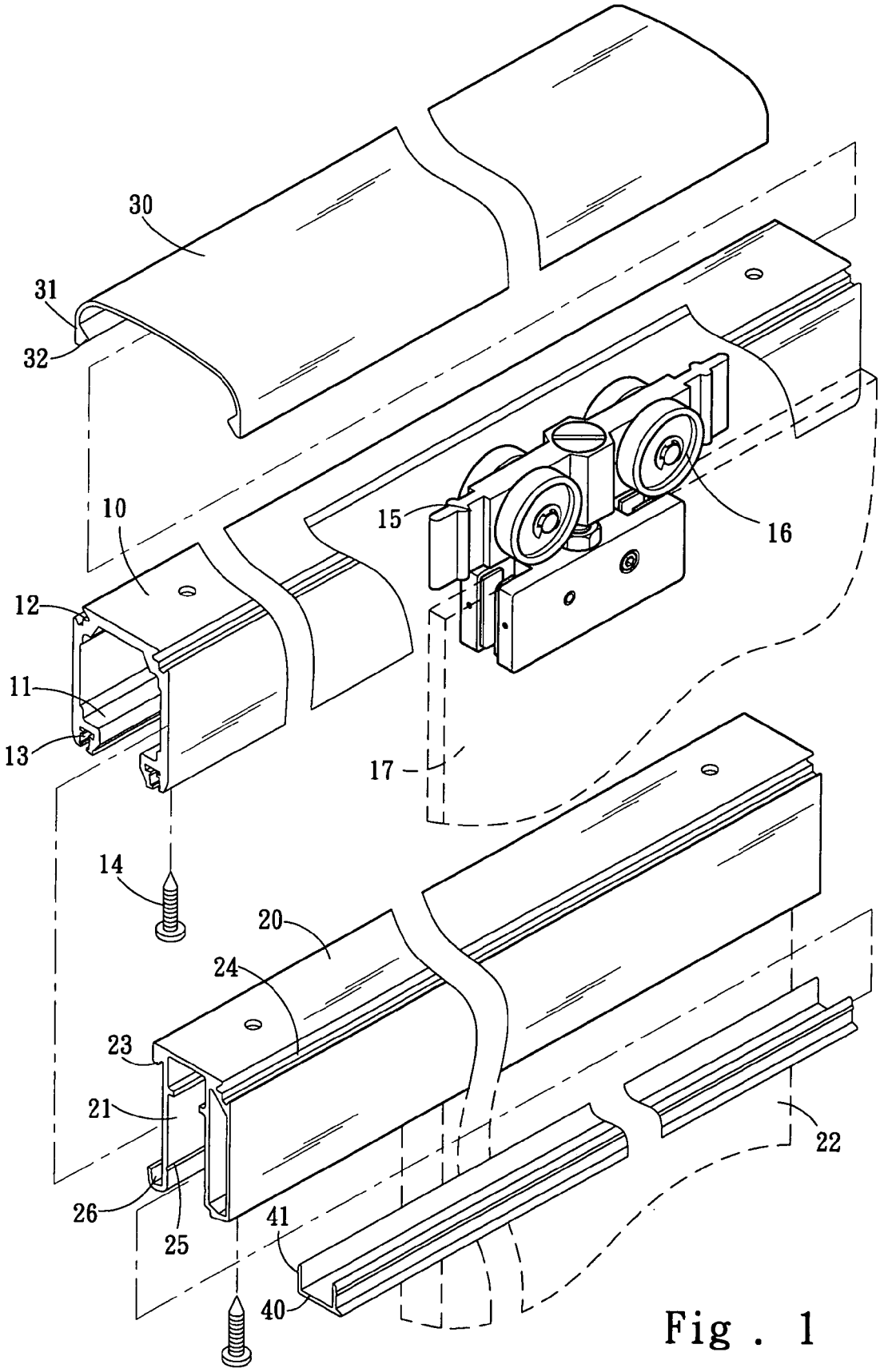
FIG. 1 is an exploded view of an embodiment of the invention.
Figure 2:
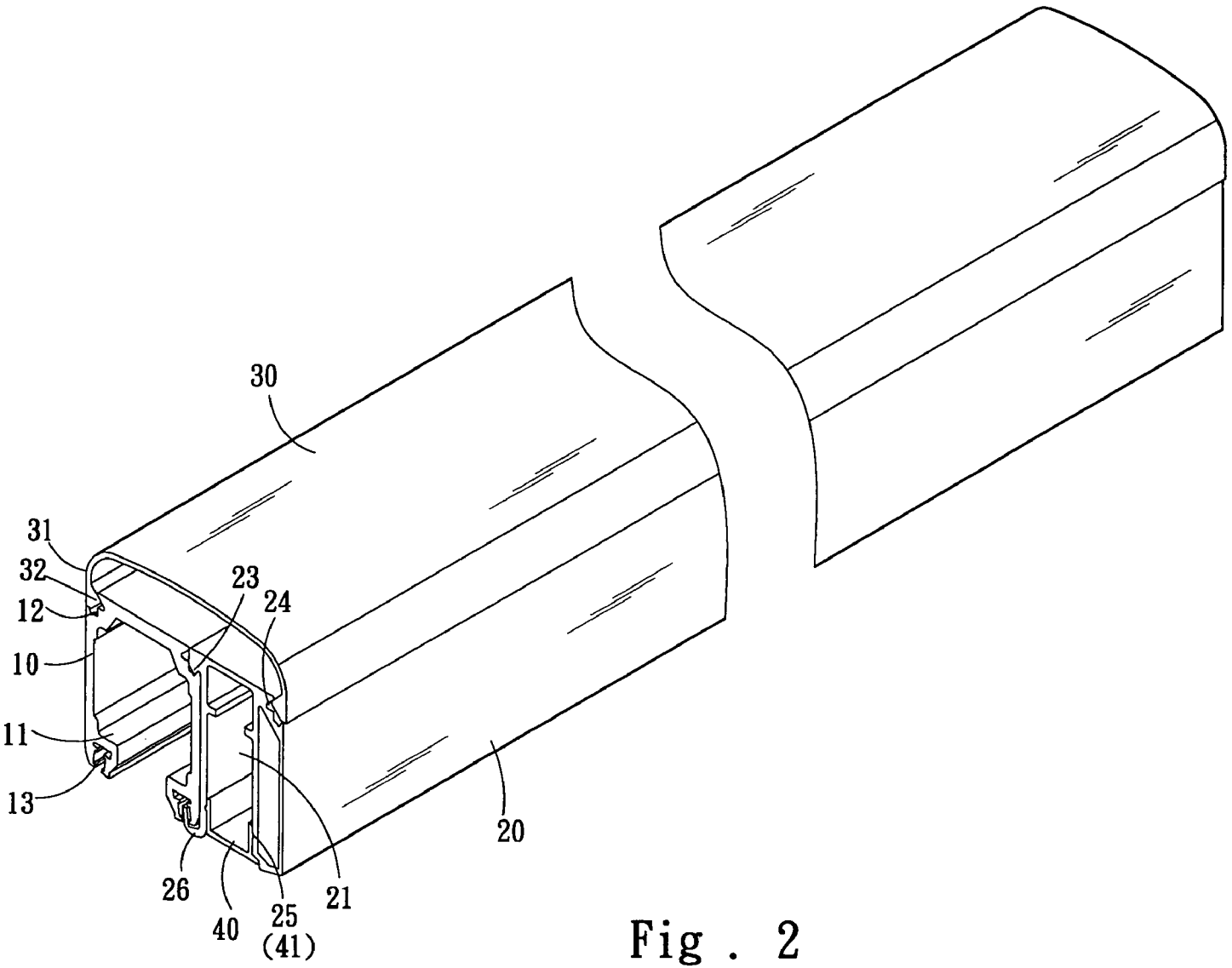
FIG. 2 is a perspective view of an embodiment of the invention.

Please refer to FIGS. 1 and 2, the sliding track coupling structure for sliding doors of the invention includes:

a sliding door track 10 which has an inverted U-shape cross section with an opening facing downwards. The sliding door track 10 has a left wall and a right wall on two sides that have respectively an inner wall with a pair of guiding tracks 11 formed thereon. The sliding door track 10 further has a first wedge troughs 12 on an upper left corner and an upper right corner, and a pair of second wedge troughs 13 on the left side and right side of the bottom thereof. The top of the sliding door track 10 is fastened to a ceiling through a fastening element 14 (such as a screw) directing upwards;

a hanging track 15 which has a plurality of rollers 16 located on the left side and right side in a transverse manner. It also is fastened to a sliding door 17 on a lower side;

a glass fixed panel track 20 which has a top portion fastened to a ceiling through another fastening element (such as a screw). It has an inverted U-shape cross section with an opening facing downwards to form a clipping trough 21 to clip a glass fixed panel 22. The glass fixed panel 22 may be a transparent or translucent glass or acrylic. The glass fixed panel track 20 has a latch portion 23 close to the first wedge trough 12 of the sliding door track 10 and a hook 26 beneath the latch portion 23 and a third wedge trough 24 on an outer side corner opposing the latch portion 23, and a pair of indented latch troughs 25 on a lower side of the inner wall of the clipping trough 21;

an ornamental plate 30 formed in a U-shape with an opening facing downwards. It has a pair of side panels 31 on the left side and right side, and a pair of wedge-shaped coupling portions 32 on an inner wall corresponding to and engaged with the first wedge trough 12 of the sliding door track 10 and the third wedge trough 24 of the glass fixed panel track 20 by depressing and latching; and a sealing plate 40 formed in an inverted U-shape with an opening facing upwards with two sides forming a pair of left side panel and a right side panel. The left side panel and right side panel have respectively a bulging latch portion 41 corresponding to the latch troughs 25 on the clipping trough 21 of the glass fixed panel track 20. It can slide into the clipping trough from the front side so that the latch portion 41 is wedged in the latch trough 25 to seal the clipping trough 21 on the lower side of the glass fixed panel track 20.

Figure 3:
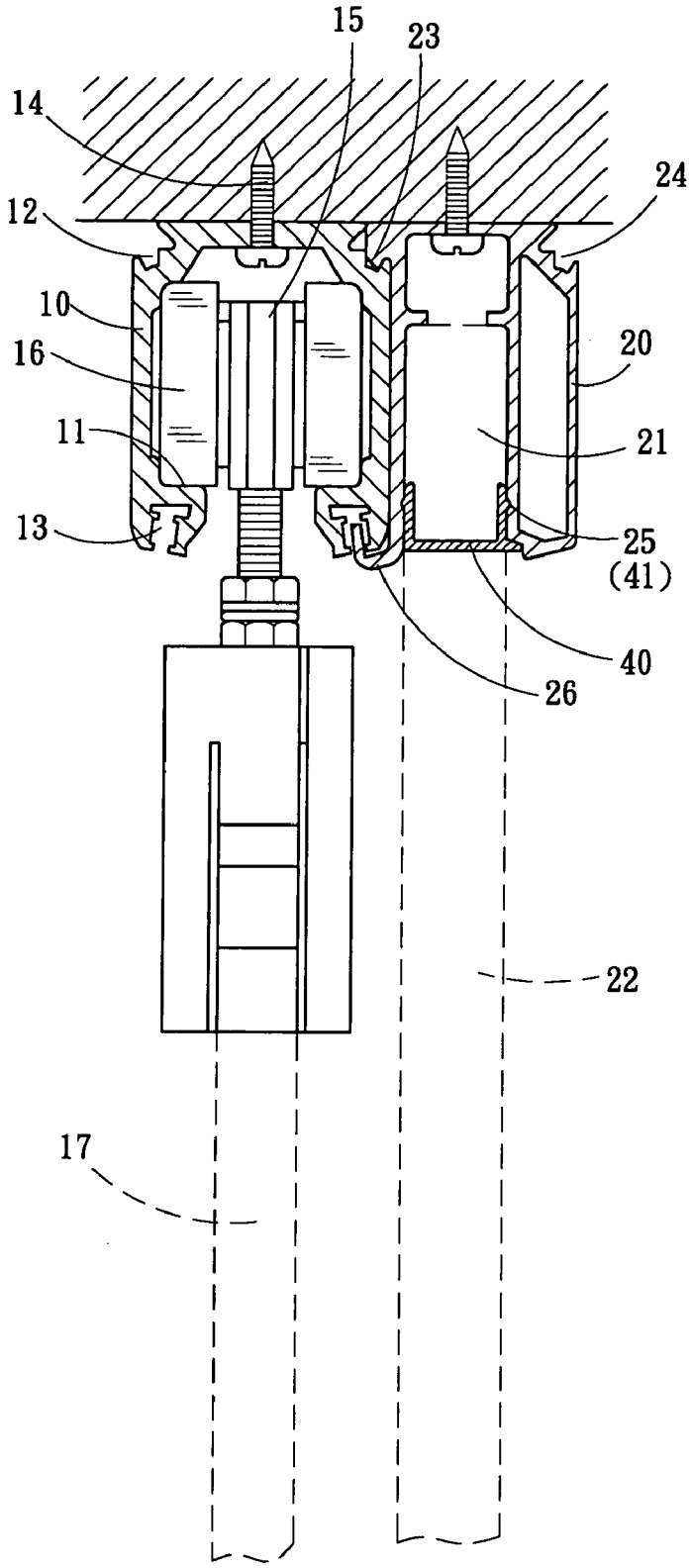
FIG. 3 is a sectional view of an embodiment of the invention.
Figure 5:
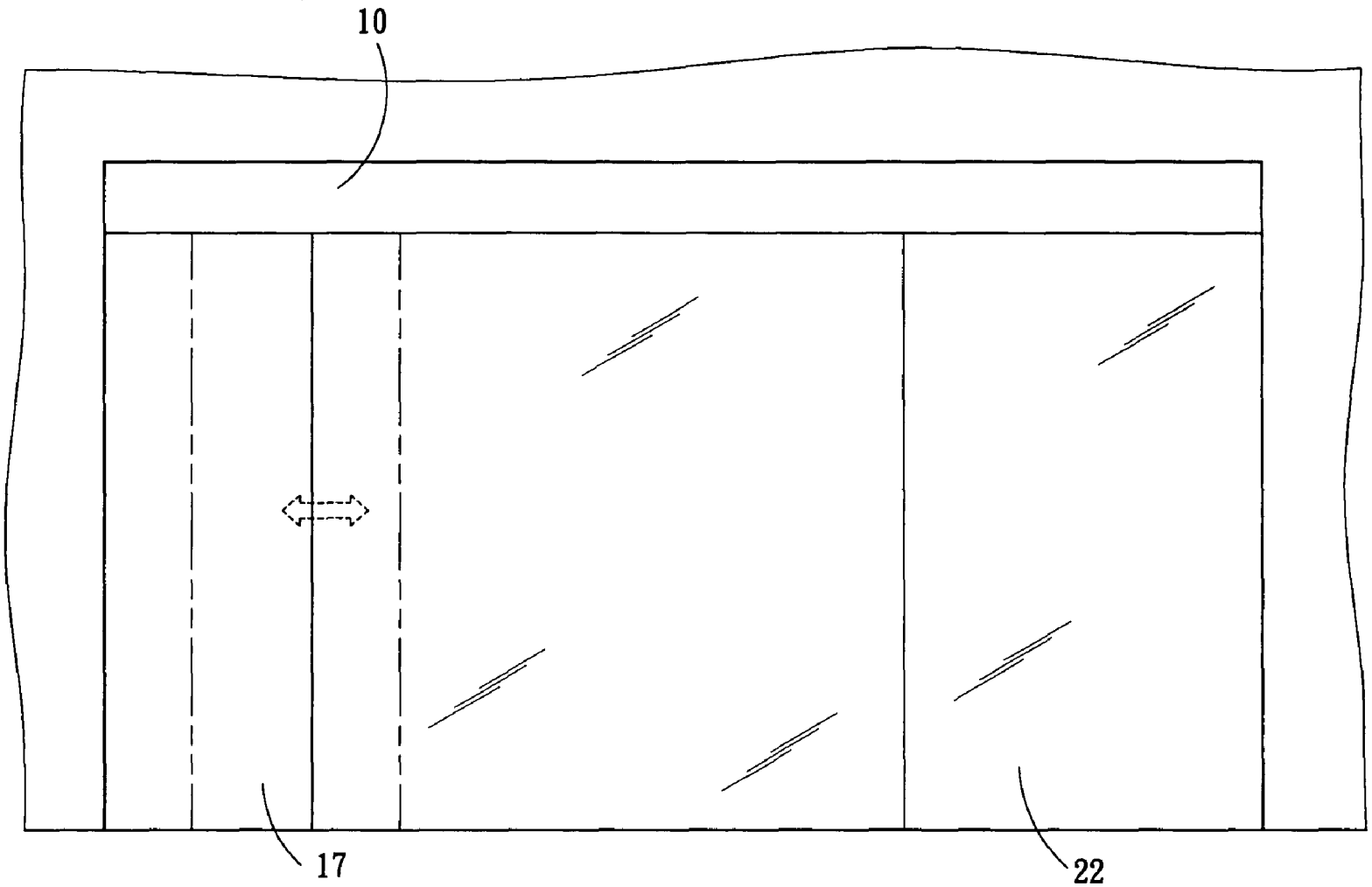
FIG. 5 is a plane view of an embodiment of the invention.

Referring to FIGS. 3 and 5, by means of the construction set forth above, to install the invention on a ceiling the sliding door track 10 may be fastened to the ceiling through a plurality of fastening elements 14 upwards. The rollers 16 of the hanging track 15 may be coupled on the guiding track 11 from the front side in a straddle manner. Then the sliding door 17 may be pushed and moved. The glass fixed panel track 20 may be fastened to one side of the sliding door track 10 by coupling respectively the latch portion 23 and the hook 26 with the first wedge trough 12 and the second wedge trough 13 from the front side. The glass fixed panel 22 fastened to the lower side of the glass fixed panel track 20 generally has a width greater than the sliding door 17. Hence when the sliding door 17 is moved open, it can be positioned on one side of the glass fixed panel 22 in a juxtaposed manner. When the sliding door 17 is moved to where the glass fixed panel track 20 is located, the clipping trough 21 is exposed and visible as the glass fixed panel 22 does not cover that portion of the glass fixed panel track 20. It is not appealing aesthetically. To remedy this problem, the sealing plate 40 may be slid into the clipping trough 21 from one side. The latch portion 41 of the sealing plate 40 can be slid along the latch trough 25 of the clipping trough 21 and latched thereon to mask the exposed portion of the clipping trough 21.

Figure 4:
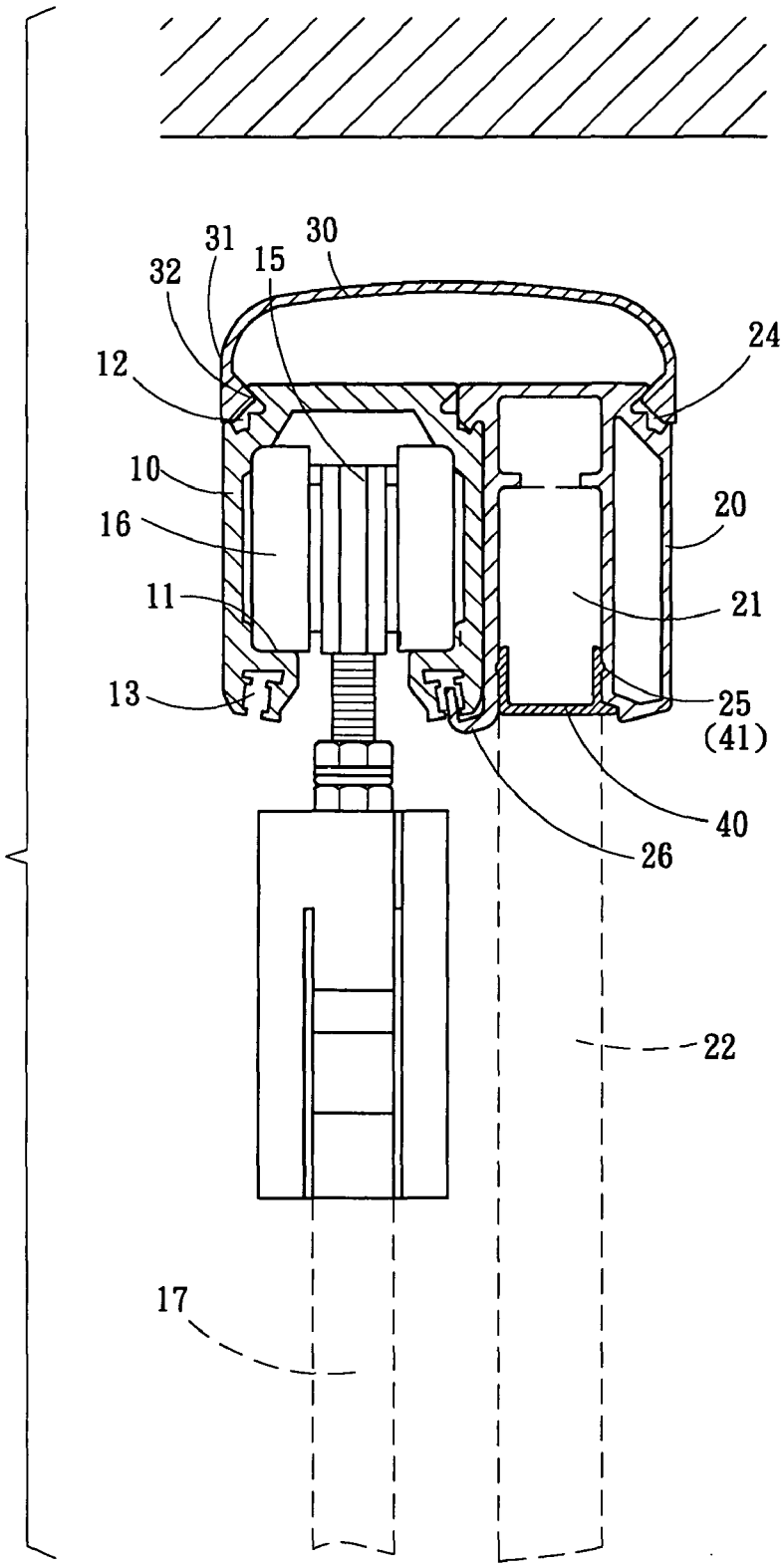
FIG. 4 is another sectional view of an embodiment of the invention.

For installing the invention in a bathroom, referring to FIG. 4, in order to space the upper side of the sliding door track 10 from the ceiling for a selected distance to facilitate air ventilation and light projection, after the sliding door track 10 and the glass fixed panel track 20 have been coupled together, one side of the sliding door track 10 and the left side and right side of the glass fixed panel track 20 have to be fixed onto a wall (viewing from the front side). In order to seal the upper side of the sliding door 10 and the top of the glass fixed panel track 20 to get a smooth appearance, the sealing plate 40 may be coupled with the first wedge trough 12 of the sliding door track 10 and the third wedge trough 24 of the glass fixed panel track 20 through the latch portions 41 on two sides of the sealing plate 40. Thus a smooth and neat profile can be formed on the top of the sliding track 10 and the glass fixed panel track 20.

In short, the sliding track 10 and the glass fixed panel track 20 are individual elements. Depending on different installation sites, the sliding door 17 may be moved to the left side or right side of the glass fixed panel track 20. The ornamental plate 30 also is an independent element and can be coupled on the bottom of the glass fixed panel track 20 when the sliding door track 10 is closed. The sealing plate 40 may be installed after the sliding door 17 is installed and an interval spaced from the ceiling is required to generate a smooth visual appeal. It provides a significant improvement over the conventional sliding tracks of sliding doors.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sliding track for sliding doors, comprising:

a sliding door track which has an inverted U-shape cross section with an opening facing downwards and a pair of guiding tracks formed on a left inner wall surface and a right inner wall surface to allow a plurality of rollers rolling thereon in a straddle manner, the rollers being hinged transversely on a hanging track which is fastened to a sliding door on a lower side, the sliding door track further having a pair of identically shaped first wedge troughs on an upper left corner and an upper right corner, and a pair of second wedge troughs on a lower side; and a glass fixed panel track which has an inverted U-shape cross section with an opening facing downwards to form a clipping trough to clip a glass fixed panel, and a latch portion corresponding to the first wedge trough of the sliding door track and a hook beneath the latch portion, the latch portion and the hook being engaged with the first wedge trough and the second wedge trough;

wherein the clipping trough has inner walls which have a pair of indented latch troughs formed thereon, the sliding track further having a sealing plate formed in an inverted U-shape that has an opening facing upwards and a left side panel and a right side panel on two sides, the left side panel and the right side panel having respectively a bulging latch portion on an outer side wall thereof corresponding to and engaged with the latch troughs of the clipping trough to hold the sealing plate on the bottom of the clipping trough.

2. A sliding track for sliding doors, comprising:

a sliding door track which has an inverted U-shape cross section with an opening facing downwards and a pair of guiding tracks formed on a left inner wall surface and a right inner wall surface to allow a plurality of rollers rolling thereon in a straddle manner, the rollers being hinged transversely on a hanging track which is fastened to a sliding door on a lower side, the sliding door track further having a pair of identically shaped first wedge troughs on an upper left corner and an upper right corner, and a pair of second wedge troughs on a lower side; and a glass fixed panel track which has an inverted U-shape cross section with an opening facing downwards to form a clipping trough to clip a glass fixed panel, and a latch portion corresponding to the first wedge trough of the sliding door track and a hook beneath the latch portion, the latch portion and the hook being engaged with the first wedge trough and the second wedge trough;

wherein the first wedge trough of the sliding door track and a third wedge trough of the glass fixed panel track are coupled with an ornamental plate which is formed in a U-shape with an opening facing downwards and has a pair of side panels on a left side and a right side that have a pair of wedge-shaped coupling portions on an inner wall corresponding to and engaged with the first wedge trough and the third wedge trough so that the ornamental plate is mountable onto an upper side of the sliding door track and the glass fixed panel track.

* * * * *